US006915755B2

(12) United States Patent
Ichihara et al.

(10) Patent No.: US 6,915,755 B2
(45) Date of Patent: Jul. 12, 2005

(54) SMALL-SIZED SURFACE BOAT

(75) Inventors: Yoshikazu Ichihara, Wako (JP); Akira Omae, Wako (JP); Yoshiaki Noda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,223

(22) Filed: Sep. 10, 2003

(65) Prior Publication Data

US 2004/0123791 A1 Jul. 1, 2004

(30) Foreign Application Priority Data

Sep. 11, 2002 (JP) ..... 2002-264967

(51) Int. Cl.[7] ..... B63B 35/73
(52) U.S. Cl. ..... 114/362; 114/55.5; 114/55.53
(58) Field of Search ..... 114/55.5, 55.53, 114/55.57, 55.55, 362

(56) References Cited

U.S. PATENT DOCUMENTS 3,426,724 A * 2/1969 Jacobson ..... 114/55.51
3,864,770 A * 2/1975 Zeilinger ..... 114/355
5,438,946 A * 8/1995 Kobayashi ..... 114/55.57
5,943,979 A * 8/1999 Hattori ..... 114/362
6,192,823 B1 * 2/2001 Tsumiyama et al. ..... 114/363

FOREIGN PATENT DOCUMENTS

JP 2849578 11/1998

* cited by examiner

*Primary Examiner*—Sherman Basinger
(74) *Attorney, Agent, or Firm*—Merchant & Gould P.C.

(57) ABSTRACT

A small-sized surface boat is configured such that a seat extending in the fore-and-aft direction is mounted on the center of a deck that constitutes an upper surface of a hull. An approximately horizontal flat portion is formed behind the seat and on a rear end portion of the deck. An inclined surface portion having an upward gradient toward a front from a front end of the flat portion is formed, and a finger catching groove to be caught by fingers of an extended hand from a rear side of the hull is integrally formed in a front end of the inclined surface portion.

5 Claims, 8 Drawing Sheets

SMALL-SIZED SURFACE BOAT

FIELD OF THE INVENTION

The present invention relates to a small-sized surface boat which includes a finger catching portion with which an occupant engages his finger when the occupant mounts the boat from a water surface onto a hull thereof.

BACKGROUND OF THE INVENTION

There has been known a stepped portion or a hand catcher which an occupant catches with his hand when he rides on a small-sized surface boat from a water surface. Referring to FIG. 8, for example, Japanese Patent Publication 2849578 discloses a small-size surface boat having a stepped portion and a hand catcher. FIG. 8 is a side view of a conventional small-sized surface boat. To enable an occupant 101 to ride on the boat 100 from a water surface 102, the boat 100 is provided with a stepped portion 104 in the vicinity of a seat 103 at a rear portion thereof and also is provided with a hand catcher 106 at a side portion thereof and on an vertical wall 105 thereof in the vicinity of the seat 103.

When the occupant 101 rides on the small-sized surface boat 100 from the water surface 102, the occupant 101 extends his left hand 108 and catches the stepped portion 104 and, at the same time, extends his right hand 109 and catches the hand catcher 106. Making use of the hand catcher 106, the occupant 101 lifts his body from the water surface 102 and can ride on the small-sized surface boat 100.

However, in the conventional small-sized surface boat 100, since the stepped portion 104 is provided in the vicinity of the seat 103, a position of the stepped portion 104 becomes excessively high from the water surface 102. Further, since the hand catcher 106 is provided in the vicinity of the seat 103 at a side portion of the small-sized surface boat 100, the position of the hand catcher 106 becomes excessively remote from the occupant 101.

On the other hand, even when the occupant 101 extends his left and right hands 108, 109 from the water surface 102, it is difficult for his left and right hands 108, 109 to reach the stepped portion 104 and the hand catcher 106. Since the occupant 101 cannot easily catch the stepped portion 104 and the hand catcher 106 with his left and right hands 108, 109, the occupant 101 cannot ride the small surface boat 100 easily.

Further, since the hand catcher 106 is mounted below a deck 100*a*, when the occupant 101 moves on the deck 100*a*, there may be a case that the hand catcher 106 obstructs the movement of the occupant 101.

In addition, to attach the hand catcher 106 to the vertical wall 105 of the small-sized surface boat 100, the hand catcher 106 is formed of a single body and is set to a mounting opening (not shown in the drawing) formed in the vertical wall 105 and, thereafter, the hand catcher 106 is mounted on the vertical wall 105 using a small bolt.

In this manner, since the hand catcher 106 and the vertical wall 105 are constituted of members separate from each other, the number of parts increases and hence, the manufacturing steps become cumbersome thus impeding the enhancement of the productivity.

SUMMARY OF THE INVENTION

A small-sized surface boat is provided comprising a seat which extends in the fore-and-aft direction mounted on the center of a deck which constitutes an upper surface of a hull, an approximately horizontal flat portion formed behind the seat and on a rear end portion of the deck, an inclined surface portion having an upward gradient in the frontward direction from a front end of the flat portion, and a finger catching groove to be caught by a finger of an extended hand from a rear side of the hull integrally formed in a front end of the inclined surface portion.

The approximately horizontally extending flat portion is formed on the rear end portion of the deck and the finger catching groove is formed in the midst portion of the inclined surface portion extending frontward from the flat portion. Accordingly, it is possible to provide the finger catching groove at a position relatively close to a water surface.

In this manner, since the flat portion is formed on the rear end portion of the deck and the finger catching groove is formed at the position relatively close to the water surface, the occupant can extend his hand from the water surface at a rear end of a hull and catch the finger catching portion with his fingers.

Further, since the finger catching portion with which the occupant engages his fingers is formed in a shape of groove, it is possible to prevent the finger catching groove from projecting upward from the deck. In addition, since the finger catching groove is integrally formed in the inclined surface portion, the number of parts can be reduced.

A level of a bottom surface of the finger catching groove is set equal to or higher than a level of the flat portion, and left-side and right-side inclined groove portions extend from both ends of the finger catching groove to the flat portion whereby water reserved in the finger catching groove is made to flow to the flat portion. Accordingly, even when water enters the finger catching groove, it is possible to make the entered water flow to the flat portion from both ends of the finger catching groove and hence, discharging of water from the finger catching groove is enhanced.

A cover is mounted between the inclined surface portion and the seat, the cover is set approximately coplanar with the inclined surface portion and an inclination approximately equal to an inclination of the inclined surface portion is provided, and an opening which communicates with a lower space of the deck is formed in a lower portion of the cover.

By constituting a portion above the finger catching groove with the cover, the inclined surface portion and the cover can form a continuous inclined surface which extends with an upward gradient from the flat portion to the seat. Accordingly, after an occupant engages his fingers with the finger catching groove and lifts his body from the water surface to the flat portion, the occupant can easily move his body to the seat along the cover from the flat portion.

Further, since the opening which communicates with a space below a deck is formed below the cover, it is possible to perform the maintenance of the equipment which are disposed in the space below the deck by making use of this opening.

There is also provided a method of mounting a small-sized surface boat by an occupant from a water surface comprising the steps of approaching from an aft direction of the small-sized surface boat from the water surface wherein the boat comprises a seat which extends in a fore-and-aft direction mounted on the center of a deck which constitutes an upper surface of a hull, an approximately horizontal flat portion formed behind the seat and on a rear end portion of the deck, an inclined surface portion having an upward gradient in the frontward direction from a front end of the flat portion, and a finger catching groove to be caught by a finger of an extended hand from a rear side of the hull in a front end of the inclined surface portion, grasping the finger catching groove and lifting the occupant from the water surface onto the approximately horizontal flat portion formed behind the seat and on the rear end portion of the deck.

BRIEF DESCRIPTION OF THE DRAWINGS

FIG. 7 is an explanatory view showing an example in which an occupant lifts his/her body onto a deck by engaging his/her finger with a finger catching groove of the small-sized surface boat according to the present invention.

DETAILED DESCRIPTION OF THE INVENTION

Modes for carrying out the present invention are explained hereinafter in conjunction with attached drawings. Here, "front", "rear", "left" and "right" are directions as viewed from a driver. The drawings are observed along the direction of symbols.

Figure 1:
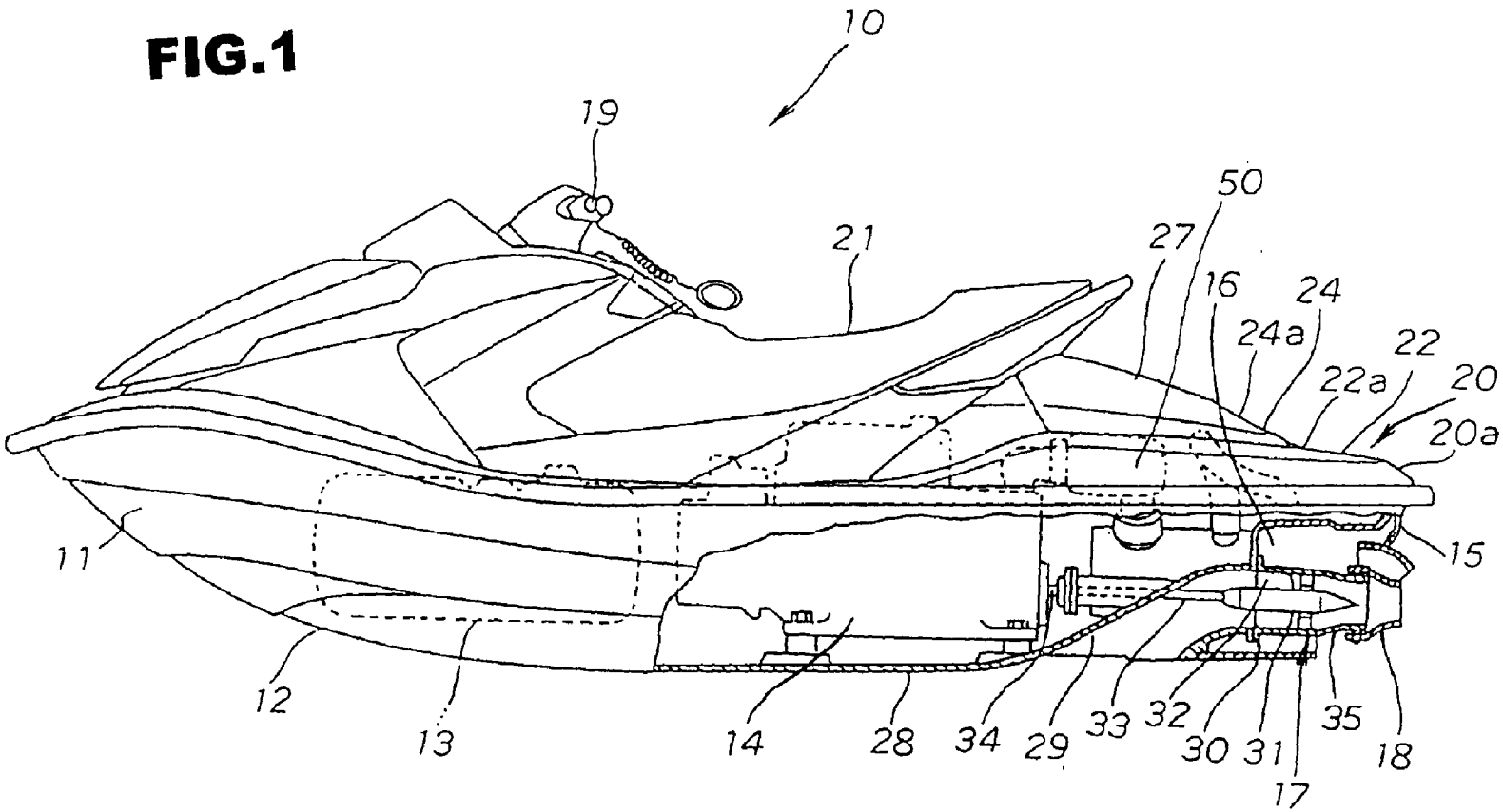
FIG. 1 is a side view showing a small-sized surface boat according to the present invention.

FIG. 1 is a side view of a small-sized surface boat according to the present invention.

The small-sized surface boat 10 is constituted as follows. A fuel tank 13 is mounted on a front portion 12 of a hull 11. An engine 14 is arranged behind the fuel tank 13. A jet propulsion chamber 16 is provided to a stem 15 disposed behind the engine 14. A water jet propulsion machine 17 is arranged in the jet propulsion chamber 16. A steering nozzle 18 is provided behind the water jet propulsion machine 17. A steering handle 19 which steers the steering nozzle 18 is arranged above the fuel tank 13. A seat 21 which is arranged behind the steering handle 19 and extends in the fore-and-aft direction at the center of a deck 20 which constitutes an upper surface of the hull 11 is formed. A rear flat portion (a flat portion) 22 which extends approximately horizontally in the frontward direction from a rear end portion 20*a* of the deck 20 is arranged behind the seat 21. Further, an inclined surface portion 24 having an upward gradient toward the seat 21 from the front-end center (front end) 22*a* of the flat portion 22 is provided. A finger catching groove 26 (see FIG. 2) is formed on the front end portion 24*a* of the inclined surface portion 24. A cover 27 is provided between the finger catching groove 26 and the seat 21.

The water jet propulsion machine 17 is configured such that a suction port 29 is formed in a hull bottom 28 of the hull 11, the suction port 29 extends to the jet propulsion machine chamber 16, a cylindrical stator 31 is formed on a wall portion (a stator plate) 30 of the jet propulsion chamber 16, an impeller 32 is arranged inside the stator 31, and a drive shaft 34 is connected to a shaft 33 of the impeller 32. The drive shaft 34 is a shaft which has a front end thereof connected to the engine 14 so as to output a drive force of the engine 14.

According to this small surface boat 10, by rotating the drive shaft 34 by the engine 14, the impeller 32 can be rotated by way of the shaft 33. By rotation of the impeller 32, water is sucked from the suction port 29 and is introduced into the inside of the stator 31. The introduced water is introduced into the steering nozzle 18 by way of the jet nozzle 35 provided at the rear end of the stator 31 and the water is ejected rearward as a water jet from the rear end of the steering nozzle 18. The small-sized surface boat 10 can be propelled by making use of this jet water.

Figure 2:
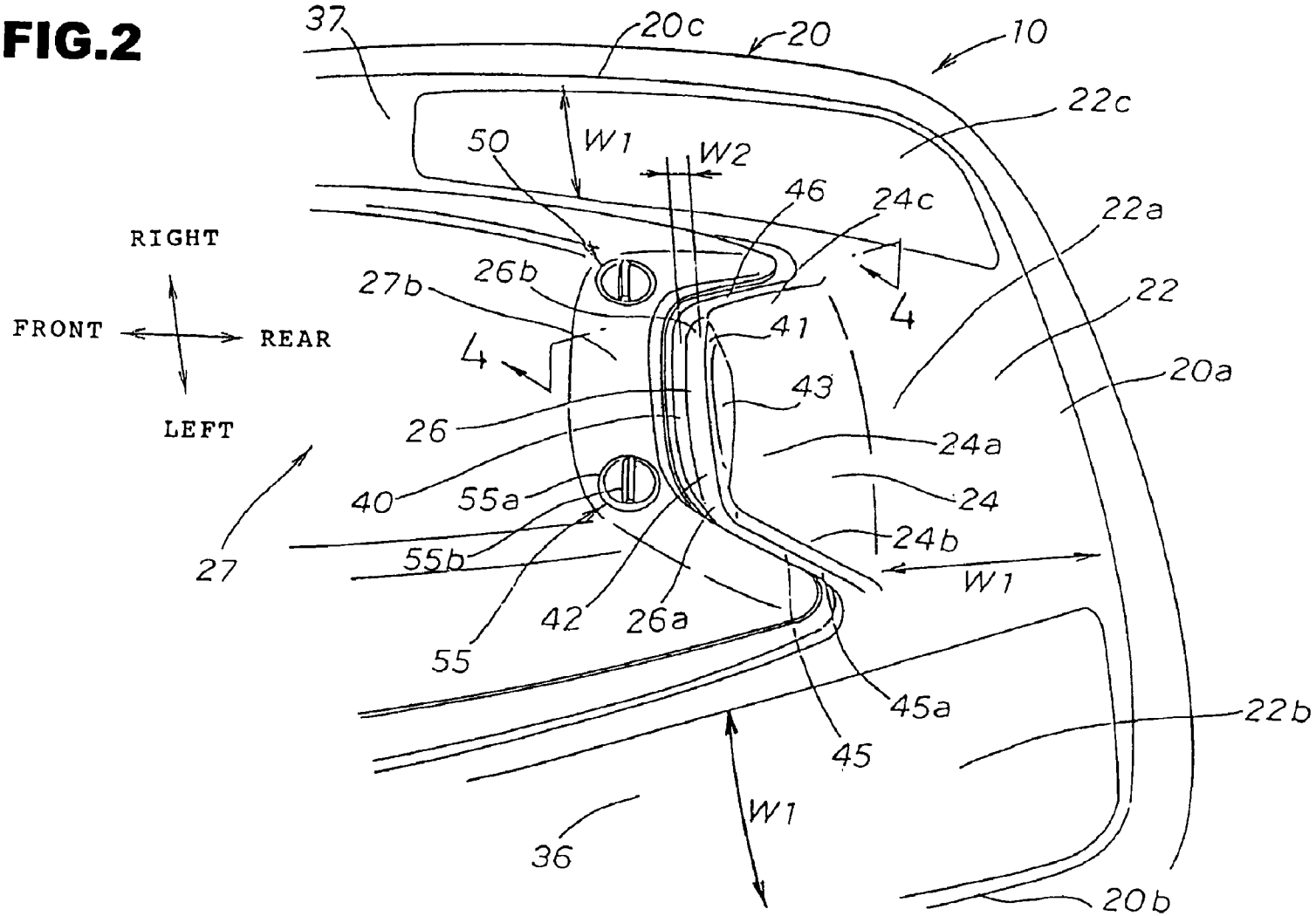
FIG. 2 is a perspective view showing an essential part of the small-sized surface boat according to the present invention.

FIG. 2 is a perspective view showing an essential part of the small-sized surface boat according to the present invention.

The small-sized surface boat 10 is configured as follows. A rear flat portion 22 extends approximately horizontally in the frontward direction from the rear end portion 20*a* of the deck 20. That is, the approximately flat rear portion 22 is formed at the rear end portion 20*a* of the deck 20. A left flat portion 36 extends approximately horizontally in the frontward direction along a left side periphery 20*b* of the deck 20 from a left end 22*b* of the rear flat portion 22, while a right flat portion 37 extends approximately horizontally in the frontward direction along a right side periphery 20*c* of the deck 20 from a right end 22*c* of the rear flat portion 22. An inclined surface portion 24 having an upward gradient which extends toward the seat 21 (see FIG. 1) from the center of the front end (the front end) 22*a* of the rear flat portion 22 is provided, and a finger catching groove 26 is formed in a front end portion 24*a* of the inclined surface portion 24.

The rear flat portion 22 and the left and right flat portions 36, 37 are portions where respective flat widths W1 are set fixed approximately and, at the same time, respective surfaces are formed coplanar. The rear flat portion 22 and the left and right flat portions 36, 37 serve for the movement of an occupant and can be also effectively used as portions where caution marks or the like are adhered.

The inclined surface portion 24 is formed with a relatively gentle inclination which extends toward the front portion of the hull 11 and a finger catching groove 26 is integrally formed in a front end portion 24*a* thereof close to the rear end portion 20*a* side of the deck 20.

Since the finger catching groove 26 is formed in the inclined surface portion 24 having the relatively gentle inclination and close to the rear end portion 20*a* side of the deck 20, the occupant can extend his hand from the rear end portion 20*a* of the deck 20 and can engage his fingers with the finger catching groove 26.

Further, by integrally forming the finger catching groove 26 in the inclined surface portion 24, the number of parts can be reduced. The reduction of the number of parts brings about the simplification of the manufacturing steps.

The finger catching groove 26 is formed approximately parallel to the rear end portion 20*a* of the deck 20, is constituted of front and rear groove walls 40, 41 and a bottom surface 42, and forms a curved recessed portion 43 in the rear groove wall 41.

The finger catching groove 26 sets a groove width thereof W2 to facilitate catching of the finger catching groove 26 by the fingers. Further, by forming the curved recessed portion 43 in the rear groove wall 41, catching of the finger catching groove 26 by the fingers by extending the hand from the rear portion of the hull 11, that is, from the rear end portion 20*a* of the deck 20 is facilitated.

A left-side inclined groove portion 45 extends in the backward direction toward the rear flat portion 22 from a left end 26*a* of the finger catching groove 26 along the left end 24*b* of the inclined surface portion 24. A right-side inclined groove portion 46 extends in the backward direction toward the rear flat portion 22 from a right end 26*b* of the finger catching groove 26 along the right end 24*c* of the inclined surface portion 24.

Figure 3:
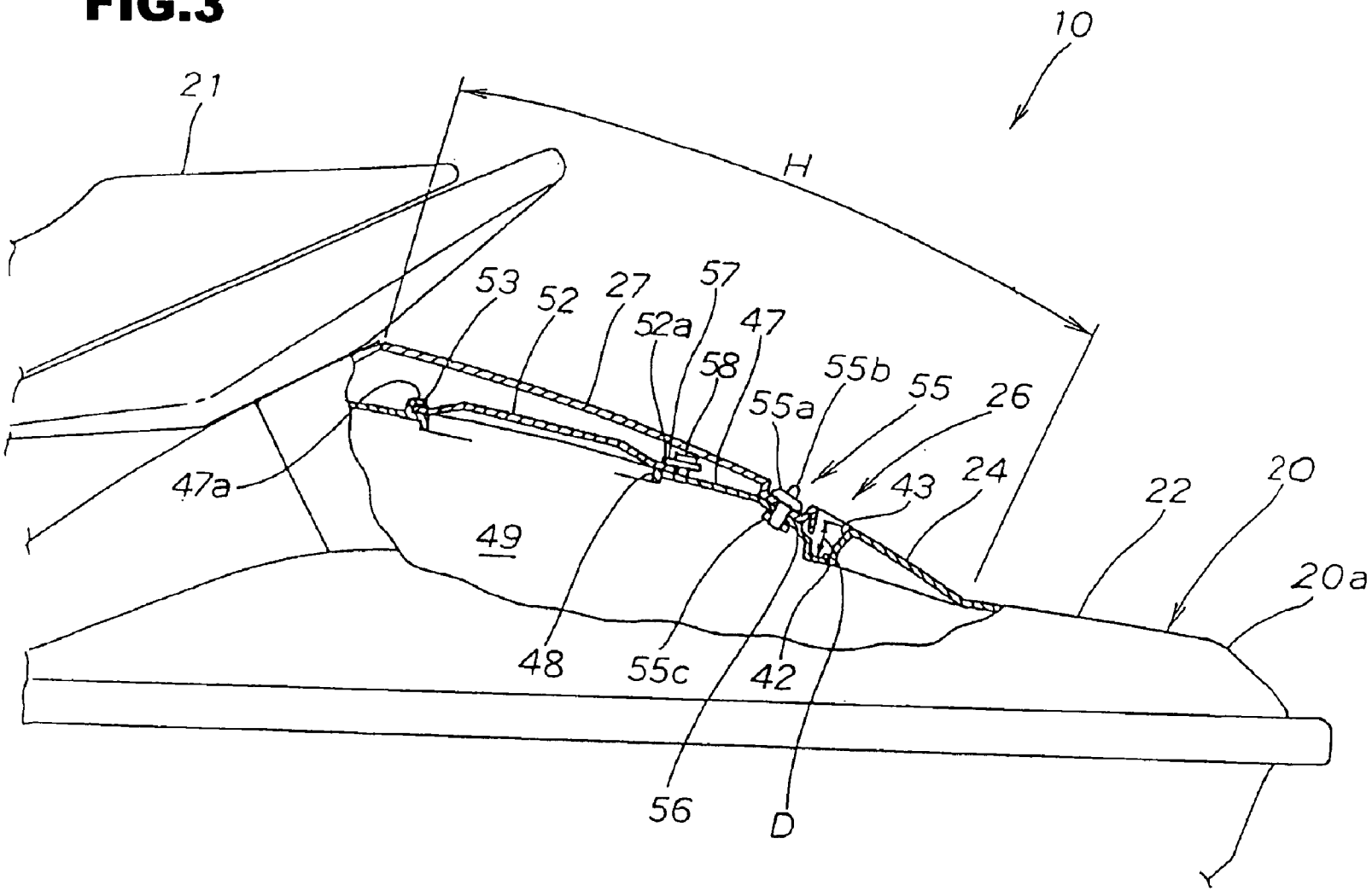
FIG. 3 is a cross-sectional view showing an essential part of the small-sized surface boat according to the present invention.

FIG. 3 is a cross-sectional view showing an essential part of the small-sized surface boat according to the present invention.

By setting the depth D of the groove, the finger catching groove 26 can ensure a shape which facilitates the engagement of the fingers with the finger catching groove 26. Further, the finger catching portion necessary for the occupant to ride on the boat from the water surface is formed into the groove configuration, that is, the finger catching groove 26. Accordingly, it is possible to prevent the finger catching groove 26 from projecting from the inclined surface portion 24, that is, the deck 20. Therefore, when the occupant moves on the deck 20, there is no possibility that the finger catching groove 26 obstructs the movement of the occupant.

By forming the finger catching groove 26 close to the rear end portion 20*a* side of the deck 20, it is possible to ensure a relatively large distance between the finger catching groove 26 and the seat 21. Accordingly, an opening 48 for maintenance can be formed in a portion 47 of the deck 20 between the finger catching groove 26 and the seat 21.

This opening 48 for maintenance faces a lower space 49 of the deck 20 and the maintenance of a group of equipment (for example, an exhaust system equipment 50 shown in FIG. 1) stored in the lower portion 49 of the deck 20 can be easily performed by making use of the opening 48.

The opening 48 is covered with a lid body 52. A front projection 53 of the lid body 52 is inserted into an insertion portion 47*a* and a rear end 52*a* of the lid body 52 is held by a locking member 57 so that the opening 48 is hermetically sealed whereby the intrusion of water to the space below the deck 20 through the opening 48 can be prevented. Here, the locking member 57 is rotatably supported on a support member 58, wherein by arranging the locking member 57 at a locked position, the rear end 52*a* of the lid body 52 can be held by the locking member 57. On the other hand, by arranging the locking member 57 at an unlocked position, the rear end 52*a* of the lid body 52 by the locking member 57 can be released.

The lid body 52 is covered with the cover 27 and, at the same time, the cover 27 is formed coplanar with the inclined surface portion 24. Further, the cover 27 is formed such that the cover 27 extends toward the seat 21 having an inclination approximately equal to an inclination of the inclined surface portion 24. Accordingly, a range H which is constituted of the inclined surface portion 24 and the cover 27 can be served for forming a continuous inclined surface extending toward the seat 21 from the rear flat portion 22 with an upward inclination.

Due to such a constitution, when the occupant lift his body from the water surface to the rear flat portion 22 by engaging his fingers with the finger catching groove 26, the occupant can easily move his body from the rear flat portion 22 to the seat 21 along the cover 27.

An engaging member (shown in FIG. 5) 54 is formed on a front end 27*a* of the cover 27 and lock buttons 55 are formed on a rear end 27*b* of the cover 27. By engaging the engaging member 54 with an engaging portion (not shown in the drawing) of the deck 20 and by engaging the lock buttons 55 to the engaging portions 56 of the deck 20, the cover 27 can be mounted on the deck 20 so as to cover the lid body 52.

Returning now to FIG. 2, the lock buttons 55 are configured such that the lock buttons 55 are respectively rotatably mounted on the left and right sides of the rear end 27*b* of the cover 27 and projections 55*b* are formed on the surfaces 55*a* of the lock buttons 55. When projections 55*b* are arranged horizontally (state shown in the drawing), as shown in FIG. 3, it is possible to engage distal ends 55*c* of the lock buttons 55 with the engaging portions 56 of the deck 20. On the other hand, when the projections 55*b* are vertically arranged by rotating the lock buttons 55 by 90°, it is possible to release the engagement between the distal end 55*c* of the lock buttons 55 shown in FIG. 3 and the engaging portions 56 of the deck 20.

Figure 4:
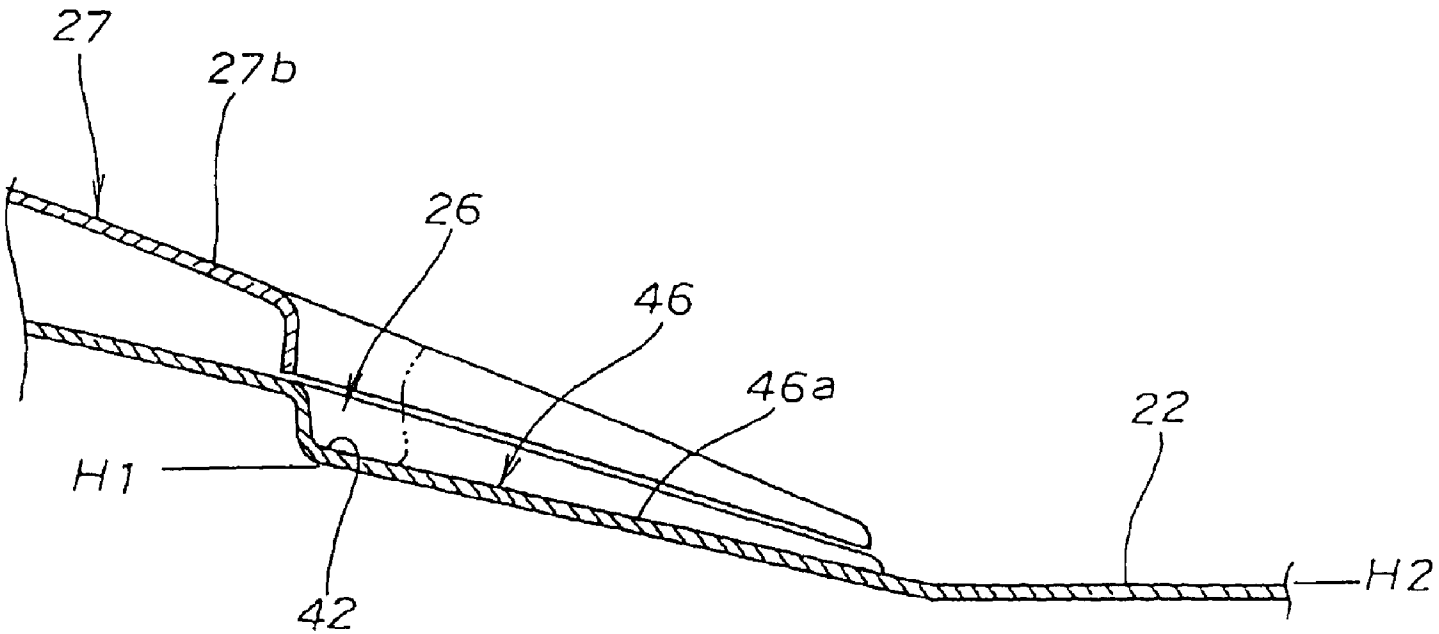
FIG. 4 is a cross-sectional view taken along a line 4—4 in FIG. 2.

FIG. 4 is a cross-sectional view taken along a line in FIG. 2.

A level H1 of the bottom surface 42 of the finger catching groove 26 is set higher than a level H2 of the rear flat portion 22 so as to form a bottom surface 46*a* of the right-side inclined groove portion 46 having a downward gradient toward the rear flat portion 22 from the bottom surface 42 of the finger catching groove 26. Accordingly, even when water enters the finger catching groove 26, it is possible to make the entered water flow to the rear flat portion 22 through the bottom surface 46*a* of the right-side inclined groove portion 46 from the finger catching groove 26.

The left-side inclined groove portion 45 (see FIG. 2) of the finger catching groove 26 also has the same shape as the right-side inclined groove portion 46 and hence, it is possible to make water which enters the finger catching groove 26 flow to the rear flat portion 22 through the bottom surface 45*a* of the left-side inclined groove portion 45.

Subsequently, the manner of operation of the small-sized surface boat 10 is explained in conjunction with FIG. 5 to FIG. 7.

Figure 5:
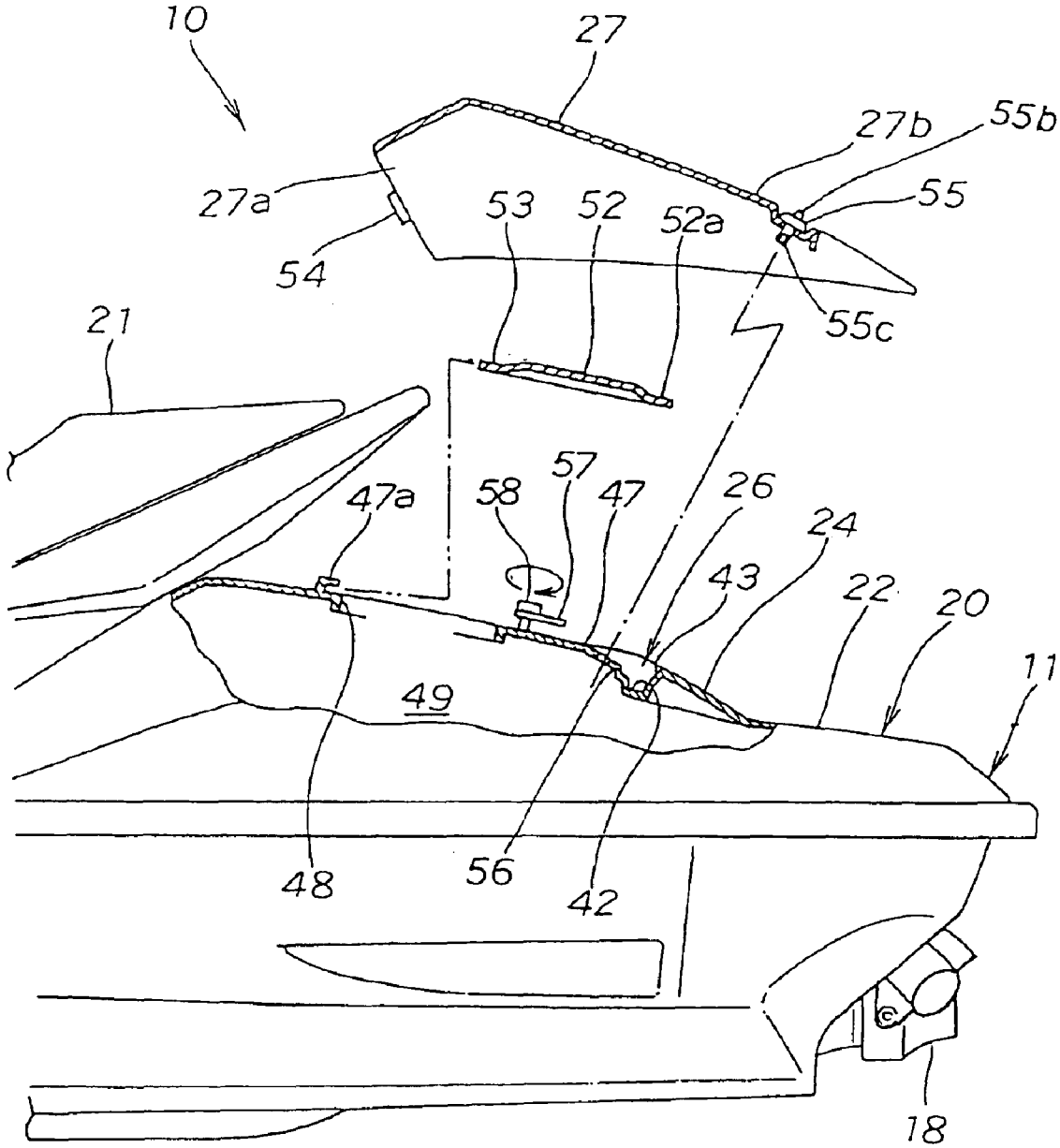
FIG. 5 is an explanatory view showing an example in which the maintenance of a group of equipment inside a hull is performed by opening an opening of the small-sized surface boat according to the present invention.

FIG. 5 is an explanatory view showing an example of performing the maintenance of a group of equipment in the hull by opening the opening 48 of the small-sized surface boat according to the present invention.

The cover 27 is removed from the deck 20 by manipulating the lock buttons 55 and the lock members 57 are arranged at the unlocked position by rotating the lock member 57 in the arrow direction. In this state, the front projection 53 of the lid body 52 is pulled out of the insertion portion 47*a* and the lid body 52 is removed from the deck 20 so that the opening 48 can be opened.

By making use of the opening 48, the maintenance of a group of equipment (for example, a group of exhaust system equipment 50 shown in FIG. 1) in the lower space 49 of the deck 20 can be performed in a short time without spending time and efforts.

Figure 6:
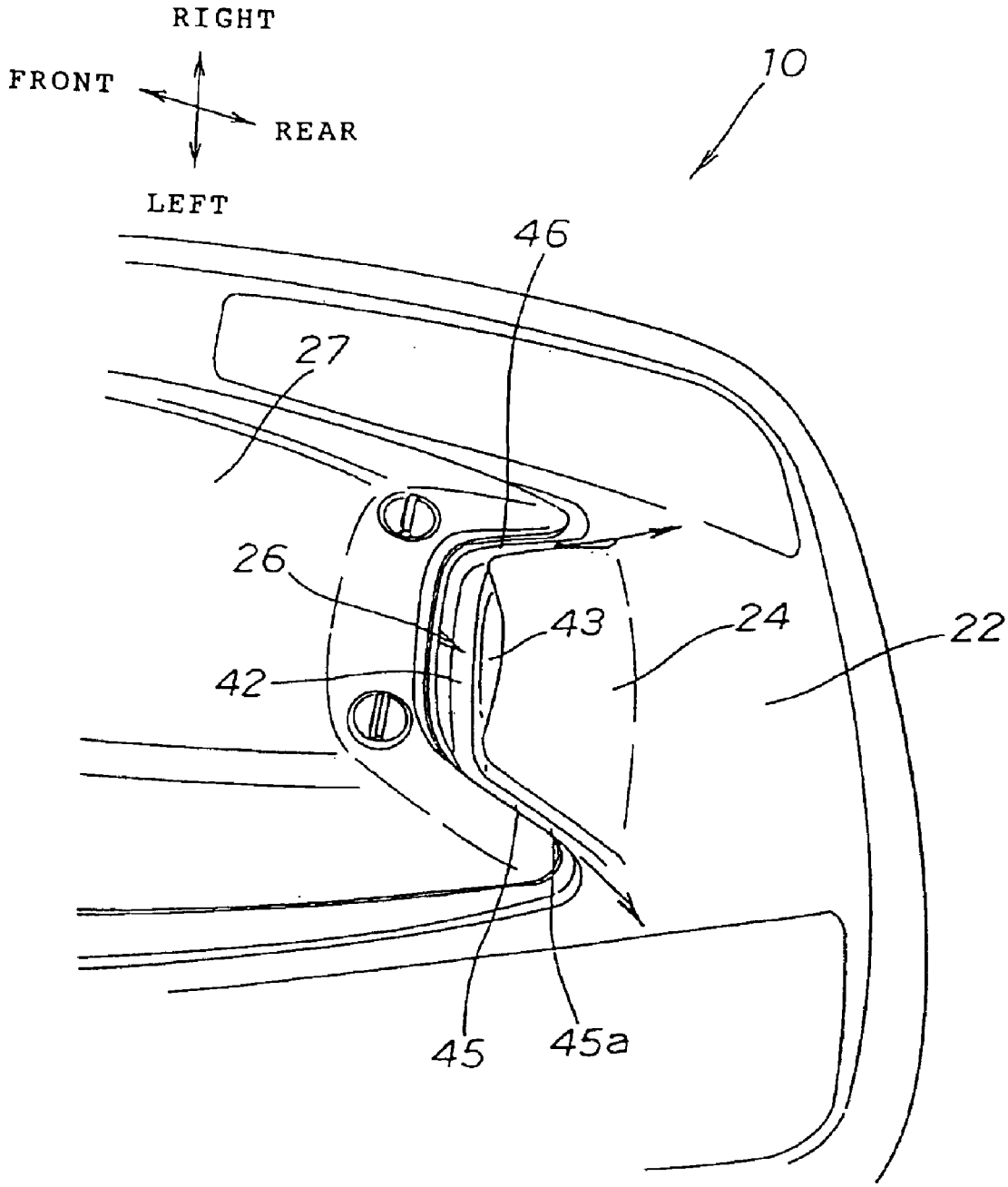
FIG. 6 is an explanatory view showing an example in which water enters a finger catching groove of the small-sized surface boat according to the present invention.

FIG. 6 is an explanatory view showing an example in which water enters the finger catching groove of the small-sized surface boat according to the present invention.

The level H1 (see FIG. 4) of the bottom surface 42 of the finger catching groove 26 is set higher than the level H2 (see FIG. 4) of the rear flat portion 22 so as to form the bottom surfaces 45*a*, 46*a* of the left-side and right-side inclined groove portions 45, 46, respectively (see FIG. 4) such that they have the downward gradient toward the rear flat portion 22 from the bottom surface 42 of the finger catching groove 26. Accordingly, even when water enters the finger catching groove 26, it is possible to make the entered water flow to the rear flat portion 22 from the finger catching groove 26 through the bottom surfaces 45*a*, 46*a* of the left-side and right-side inclined groove portions 45, 46 as shown in the arrow direction. Therefore, discharging of water from the finger catching groove 26 can be accelerated and hence, the retention of water in the water catching groove 26 can be prevented.

Figure 7A:
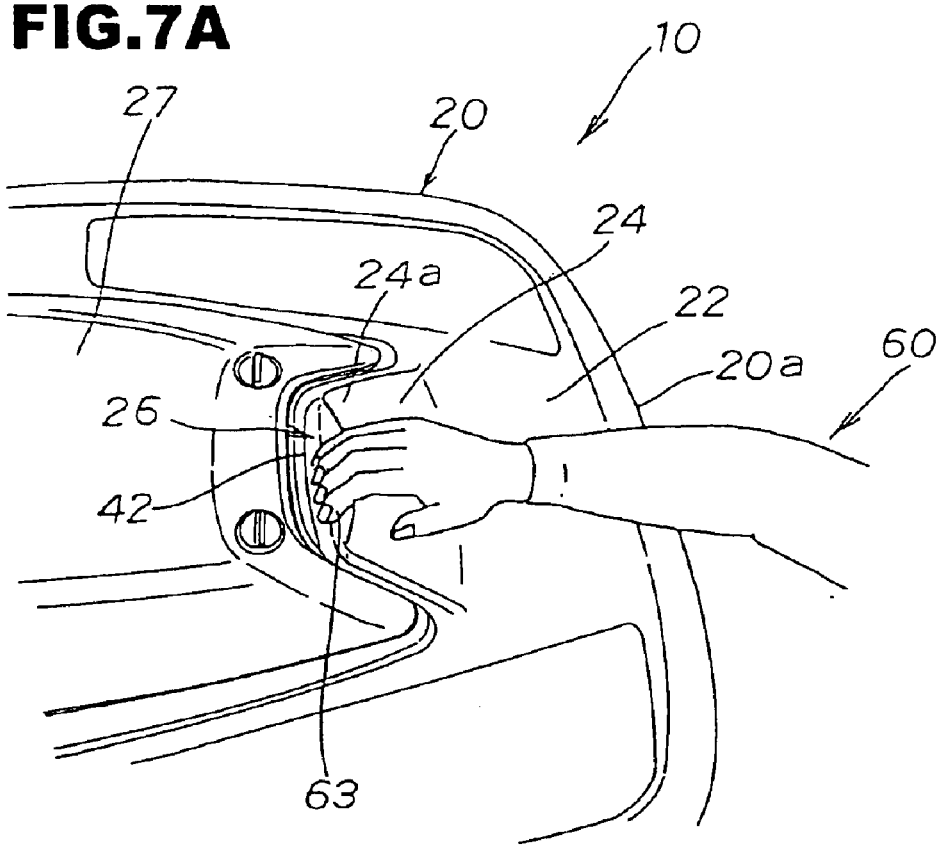
FIG. 7A is an explanatory view showing an example in which an occupant engages his/her finger with a finger catching groove of the small-sized surface boat according to the present invention.
Figure 7B:
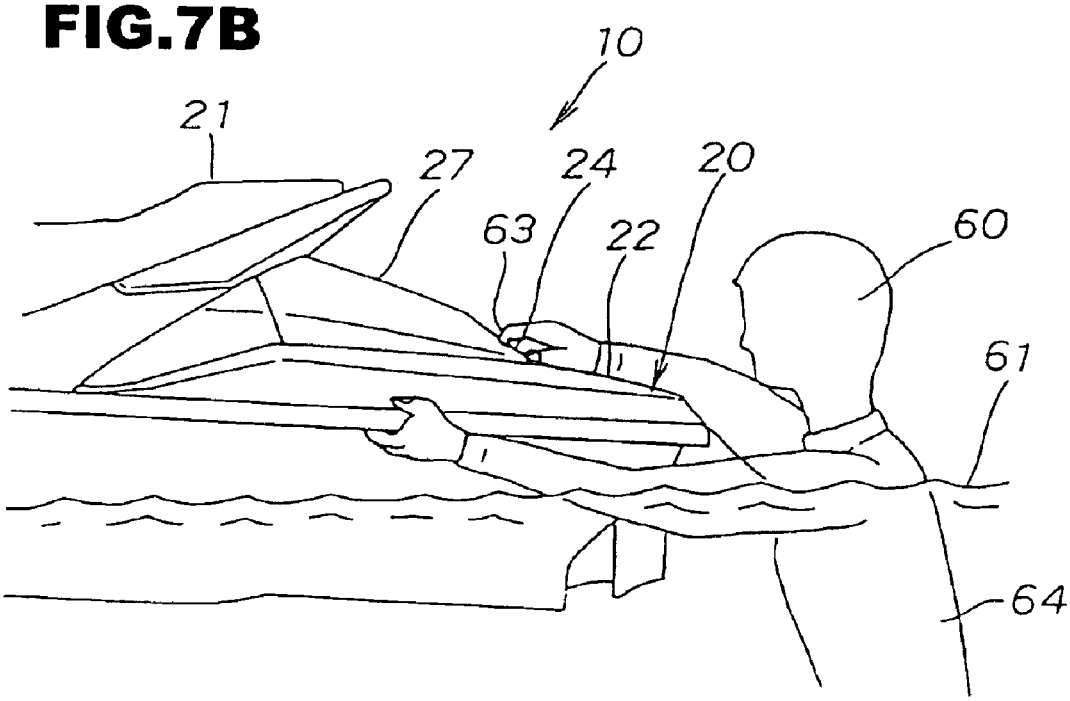
FIG. 7B is an explanatory view showing an example in which an occupant can lift his/her body from the water to the deck after engaging the finger catching groove.
Figure 8:
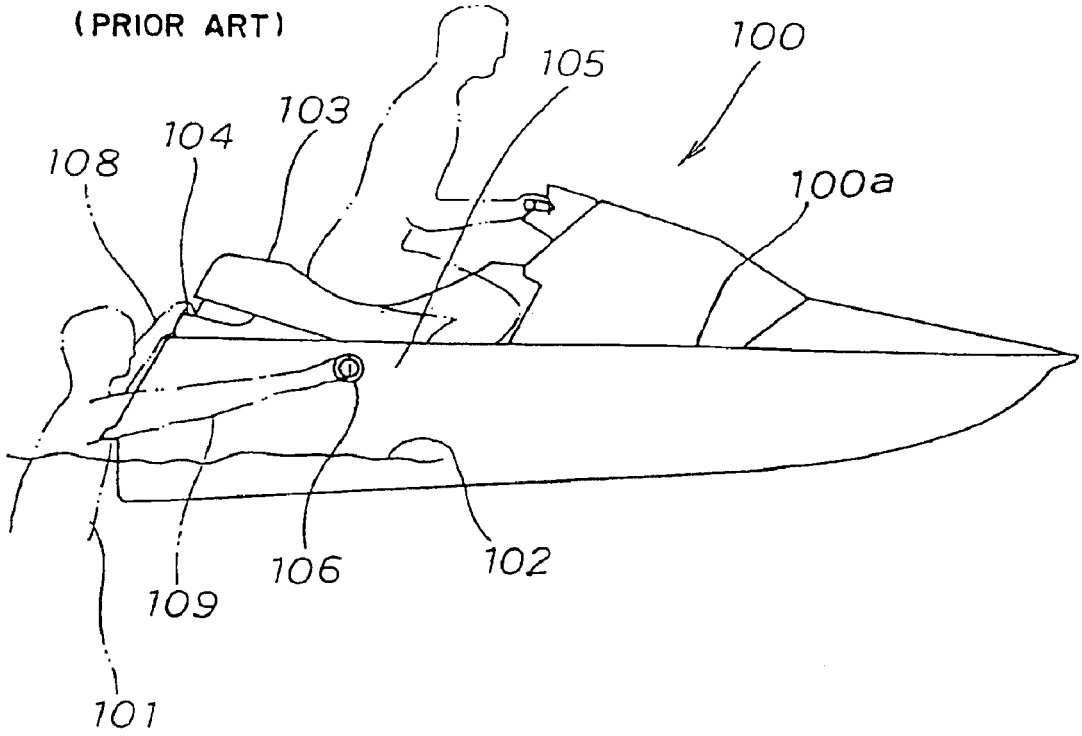
FIG.8 (PRIOR ART)
FIG. 8 is a side view of a conventional small-sized surface boat.

FIGS. 7(*a*), (*b*) are explanatory views for explaining an example to lift the body of the occupant onto the deck by engaging the finger with the finger catching groove of the small-sized surface boat according to the present invention.

In FIG. 7(*a*), the rear flat portion 22 which extends approximately horizontally can be formed on the rear end portion 20*a* of the deck 20 and the finger catching groove 26 is formed in the front end portion 24*a* of the inclined surface portion 24 extending frontward from the rear flat portion 22. In this manner, by forming the finger catching groove 26 close to the rear flat portion 22, it is possible to form the finger catching portion 26 at a position relatively close to the water surface 61 (see FIG. 7.(*b*)). Accordingly, the occupant 60 can extend his hand 62 from the water surface 61 at the rear portion of the hull body and can easily engage the fingers 63 with the finger catching groove 26. In FIG. 7(*b*), after engaging his fingers 63 with the finger catching groove 26, the occupant 60 can easily lift his body 64 to the deck 20 from the water surface 61 by making use of the rear flat portion 22.

Further, the cover 27 and the inclined surface portion 24 are made coplanar and the cover 27 is formed such that the cover extends toward the seat 21 with the inclination approximately equal to the inclination of the inclined surface portion 24 (see FIG. 3). Accordingly, after the occupant 60 lifts his body 64 onto the rear flat portion 22, he can easily move his body 64 to the seat 21 from the rear flat portion 22 along the cover 27. Accordingly, the occupant 60 can relatively easily ride on the small-sized surface boat 10 from the water surface 61.

Here, in the above-mentioned embodiment, the explanation is made with respect to the example in which the level H1 of the bottom surface 42 of the finger catching groove 26 is set higher than a level H2 of the rear flat portion 22 so as to form bottom surfaces 45*a*, 46*a* of the left-side and right-side inclined groove portions 45, 46 respectively having the downward gradient toward the rear flat portion 22 from the bottom surface 42 of the finger catching groove 26. However, the present invention is not limited to the above and the level of the bottom surface 42 of the finger catching groove 26 may be set equal to the level of the rear flat portion 22. Also in this case, it is possible to make water which enters the finger catching groove 26 flow into the rear flat portion 22 through the left and right-side inclined groove portions 45, 46 as shown in the arrow.

Further, in this embodiment, although the explanation is made with respect to the example in which the recessed portion 43 is formed in the rear groove wall 41 of the finger catching groove 26, the recessed portion 43 may not be formed.

In this embodiment, the explanation is made with respect to the example in which the left-side and right-side inclined groove portions 45, 46 are respectively formed in the left and right ends 26*a*, 26*b* of the finger catching groove 26. However, the present invention is not limited to this embodiment and the left-side and right-side inclined groove portions 45, 46 may not be formed in the left and right end 26*a*, 26*b* of the finger catching groove 26.

Although the explanation is made with respect to the example in which the shape of the finger catching groove 26 extends horizontally, the shape of the finger catching groove 26 can be formed arbitrarily.

Although the explanation is made with respect to the example in which the flat width W1 of the rear flat portion 22 and the left and right flat portions 36, 37 is set substantially equal, it is possible to make the flat width of the rear flat portion 22 and the flat width of the left and right flat portions 36, 37 different from each other.

While the invention has been described in particular embodiments, it is to be understood that the words which have been used are words of description rather than limitation and that changes within the purview of the appended claims may be made with out departing from the true scope and spirit of the invention in its broader aspects.

We claim:

1. A small-sized surface boat comprising:

a hull;

a deck constituting an upper surface of the hull;

a seat which extends in a fore-and-aft direction mounted on the deck;

an approximately horizontal flat portion formed behind the seat and on a rear end portion of the deck;

an inclined surface portion having an upward gradient in the frontward direction from a front end of the flat portion; and a finger catching groove in a front end of the inclined surface portion to be caught by a finger of an extended hand from a rear side of the hull;

wherein a level of a bottom surface of the finger catching groove is set equal to or higher than a level of the flat portion, and left-side and right-side inclined groove portions extend from both ends of the finger catching groove to the flat portion whereby water reserved in the finger catching groove is made to flow to the flat portion.

2. A small sized surface boat comprising:

a hull;

a deck constituting an upper surface of the hull;

a seat which extends in a fore-and-aft direction mounted on the deck;

an approximately horizontal flat portion formed behind the seat and on a rear end portion of the deck;

an inclined surface portion having an upward gradient in the frontward direction from a front end of the flat portion; and a finger catching groove in a front end of the inclined surface portion to be caught by a finger of an extended hand from a rear side of the hull, the finger catching groove being partially constituted by a cover which forms a continuous inclined surface that extends with an upward gradient from the flat portion to the seat.

3. A small-sized surface boat comprising:

a hull;

a deck constituting an upper surface of the hull;

a seat which extends in a fore-and-aft direction mounted on the deck;

an approximately horizontal flat portion formed behind the seat on a rear end portion of the deck;

an inclined surface portion having an upward gradient in the frontward direction from a front end of the flat portion;

a finger catching groove in a front end of the inclined surface portion to be caught by a finger of an extended hand from a rear side of the hull; and a cover mounted between the inclined surface portion and the seat, the cover being set approximately coplanar with the inclined surface portion and an inclination approximately equal to an inclination of the inclined surface portion.

4. A small-sized surface boat according to claim 3, wherein the cover provides access to an opening in the deck for maintenance of equipment in a lower portion of the deck.

5. A small-sized surface boat according to claim 4, wherein the opening is covered by a lid that hermetically seals the opening against intrusion of water into the lower portion of the deck.

* * * * *